United States Patent [19]

Kofahl

[11] 4,427,348

[45] Jan. 24, 1984

[54] DUPLEX HYDRAULIC AND AIR OIL WELL PUMP

[75] Inventor: William M. Kofahl, Licking, Mo.

[73] Assignee: Flying K Equipment System, Inc., Licking, Mo.

[21] Appl. No.: 264,450

[22] Filed: May 18, 1981

[51] Int. Cl.[3] ..... F04B 35/02; F04B 21/00

[52] U.S. Cl. ..... 417/342; 417/539; 417/531; 92/136; 92/137

[58] Field of Search ..... 417/529, 531, 533, 342; 92/136, 137

[56] References Cited

U.S. PATENT DOCUMENTS

| | | | |
|---|---|---|---|
| 185,787 | 12/1876 | Shollar | 417/531 |
| 222,250 | 12/1879 | Cushier | 417/531 |
| 245,281 | 8/1881 | Cotton | 417/531 |
| 253,247 | 2/1882 | Warner | 417/531 |
| 963,626 | 7/1910 | McCarty | 417/531 |
| 1,026,713 | 5/1912 | Smith | 417/533 |
| 1,098,558 | 2/1914 | Cairns | 417/531 |
| 1,233,439 | 7/1917 | Barequeras | 417/529 |
| 1,543,201 | 6/1925 | Bell | 417/342 |
| 1,864,609 | 6/1932 | Musolf | 417/529 |
| 2,702,005 | 2/1955 | Kruse | 417/343 |
| 4,049,365 | 9/1977 | Sparks | 92/137 |

*Primary Examiner*—William L. Freeh

*Attorney, Agent, or Firm*—Jerry W. Mills; Gregory M. Howison; Nina Medlock

[57] ABSTRACT

A pump (10) is disclosed for use in pumping a fluid (14) from a borehole (12) to the surface. The pump includes a first and second pumping string (20, 22) extending into the borehole and a return string (26) extending from the borehole. First and second pistons (82, 94) are slidably mounted at the ends of the first and second puming strings within the borehole, respectively for reciprocation between extended and retracted positions. First and second pumping cylinders (56, 64) are secured in fixed relation to the first and second pumping strings (20, 22) so that the first and second pistons (82, 94) are slidable therein. The pistons and pumping cylinders define first and second pumping chambers (92, 104). Each of the first and second pistons includes a gear rack (88, 100) having teeth meshing with the teeth on a stroke return gear (106). Introduction of pressurized fluid into one of the pumping strings urges the associated piston into the extended position, pumping fluid within the associated pumping chamber through one of the orifices (40, 42) into a holding chamber (124) and thereafter through a standing valve (130) into the return string (26). The gear (106) forces the opposite piston toward the retracted position, opening a inlet valve (112, 118) to permit fluid from the borehole to enter the associated pumping chamber. Fluid flow between the two pumping chambers is prevented by a valve ball (126) cooperating with the orifices (40, 42) interconnecting the pumping chambers with the holding chamber.

9 Claims, 3 Drawing Figures

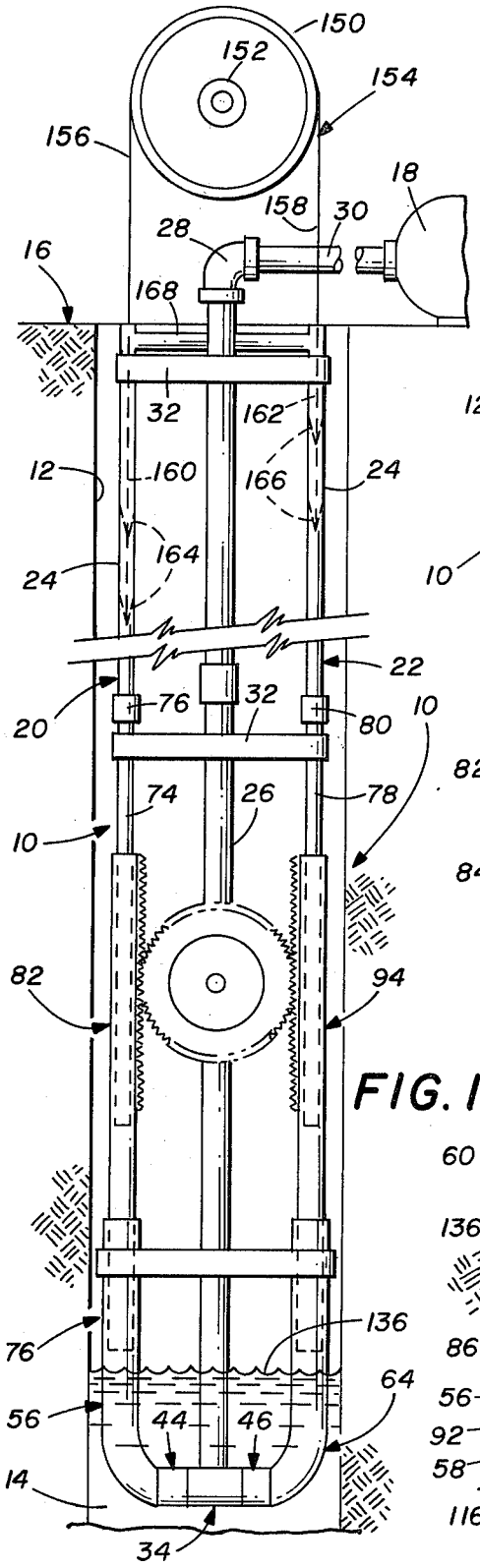
FIG. 1
FIG. 2
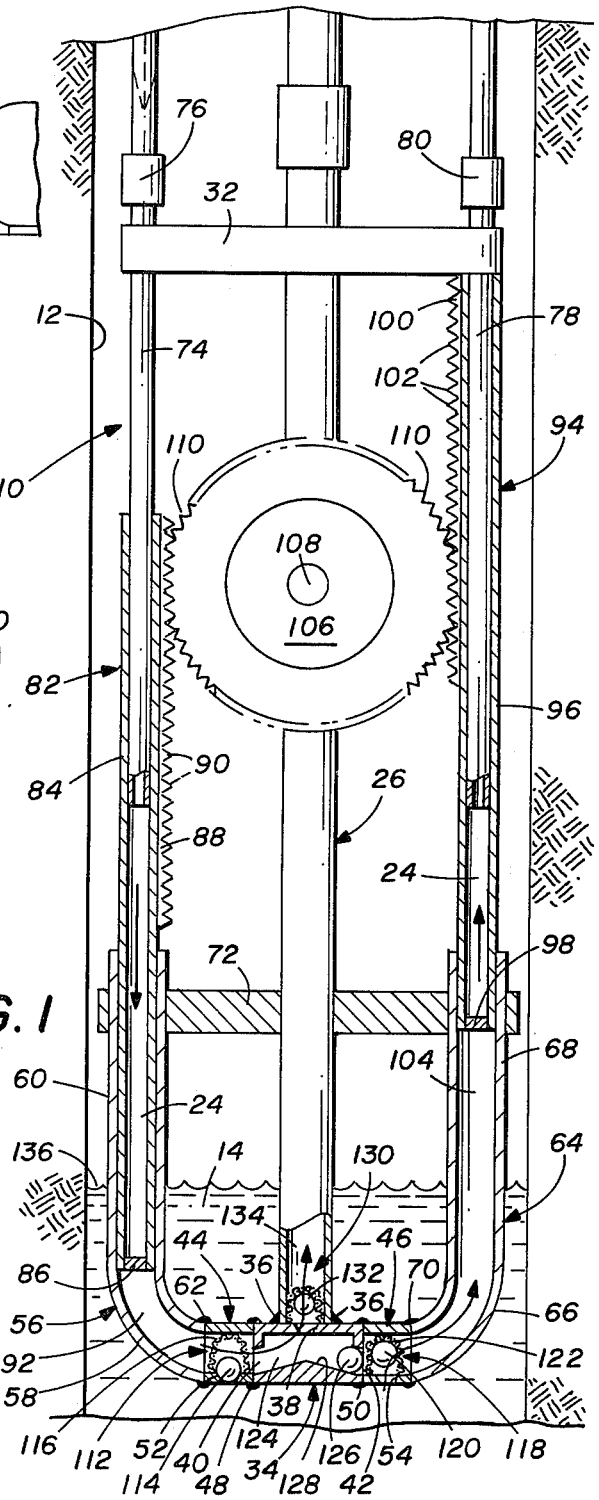

DUPLEX HYDRAULIC AND AIR OIL WELL PUMP

TECHNICAL FIELD

This invention relates to the pumping of fluids, and in particular to the pumping of oil within a borehole to the surface.

BACKGROUND ART

In the exploration for oil and other fossil fuels, a borehole is initially drilled to the depth necessary to reach the reservoir of oil. The drilling equipment is then removed and a casing is placed in the borehole to keep the borehole open. Occasionally, the pressure of the oil will be sufficient to lift the oil to the surface. However, very often it is necessary to pump the oil to the surface.

In the past, pumping units have been positioned on the surface adjacent the borehole. Rigid aligned sucker rods extend from the pumping unit at the surface to a pump within the borehole. The vertical reciprocation of the sucker rods act to operate the pump to lift the oil to the surface. While this technique has been effective, it requires precise positioning of the pumping unit on the surface and the sucker rods are subject to deformation and bending under the loads imposed. Therefore, the need exists for a more cost effective pump for lifting fluids, such as oil.

SUMMARY OF THE INVENTION

In accordance with the present invention, a pump for pumping a fluid from a first elevation to a higher second elevation is provided. The pump includes first and second pumping strings for extension to the first elevation for carrying a pumping fluid. A first piston is slidably mounted on the first pumping string for reciprocating motion between extended and retracted positions. A second piston is slidably mounted on the second pumping string for reciprocating motion between extended and retraced positions. A first cylinder is secured in a fixed relationship to the first pumping string and the first piston extends into the first cylinder to define a first pumping chamber. The volume of the first pumping chamber is varied as the first piston moves between the extended and retracted positions. The first cylinder further includes check valve structure permitting fluid to flow only from the first elevation into the pumping chamber. A second cylinder is secured in a fixed relationship to the second pumping string, the second piston extends into the second cylinder to define a second pumping chamber. The volume of the second pumping chamber is varied as the second piston is moved between the extended and retracted positions. Check valve structure permits fluid to flow only into the second pumping chamber from the first elevation. A gear structure is provided for interconnecting the first and second pistons so that motion in one piston decreasing the volume of the associated pumping chamber induces motion in the other piston to increase the volume of the associated pumping chamber. A fluid return string is provided for extending between the first and second elevations. The fluid return string includes a holding chamber communicating with both the first and second pumping chambers. The fluid return string further includes a standing valve structure interconnecting the holding chamber with the remainder of the fluid return string, the standing valve structure permitting fluid to flow only from the holding chamber to the remainder of the fluid return string. The holding chamber includes check valve structure to prevent fluid flow between the first and second pumping chambers. Entry of a pumping fluid at a predetermined pressure in the first pumping string urges the first piston to the extended position, decreasing the volume of the first pumping chamber to pressurize the fluid therein and in the holding chamber to open the standing valve structure to pump fluid up the fluid return string. The check valve structure in the holding chamber will prevent flow into the second pumping chamber while the second piston is moved to the retracted position by the gear structure to increase the volume of the second pumping chamber. The increase in volume opens the check valve structure in the second pumping chamber to permit fluid from the first elevation to enter. Entry of the pumping fluid at the predetermined pressure within the second pumping string reverses the sequence of operation to pump the fluid within the second pumping chamber from the fluid return string.

In accordance with another aspect of the present invention, a pump for pumping a fluid from a borehole is provided which includes first and second pumping strings for extension into the borehole with each of the pumping strings ending in a polish rod. Structure is provided for alternatively introducing a pumping fluid into the first and second pumping strings at a predetermined pressure. First and second pistons are slidably supported on the polish rods of the first and second pumping strings, respectively, for reciprocation thereon between retracted and extended positions, each of the pistons having a gear rack secured thereto. A fluid return string is provided for extension out of the borehole. The return string has a holding chamber therein interconnected to the remainder of the return string via a standing valve, the standing valve permitting the flow of fluid only from the holding chamber to the remainder of the return string. First and second pumping cylinders are provided, each being secured in a fixed relationship to the associated pumping string so that the associated pump piston is reciprocable within the pumping cylinders to define first and second pumping chambers, respectively. Each of the first and second pumping chambers communicates with the fluid in the borehole through a check valve permitting fluid to flow only from the borehole into the respective pumping chamber. A stroke return gear is mounted for rotation about an axis having a fixed relation to the pumping strings and pump cylinders. The teeth of the gear meshing with the teeth on the racks of both of the pump pistons so that motion in one of the pistons reducing the volume of the associated pumping chamber is imparted to the other piston to increase the volume of the associated pumping chamber. The structure for aternatively introducing a pumping fluid permits the introduction of pumping fluid into one of the pumping strings to urge the associated piston into the extended position to pump the fluid in the associated pumping chamber through the holding chamber and standing valve. The stroke return gear simulatneously moves the other piston to increase the volume of the associated pumping chamber to draw fluid from the borehole into the pumping chamber through the check valve.

BRIEF DESCRIPTION OF THE DRAWINGS

A more complete understanding of the invention and its advantages will be apparent from the following Detailed Description taken in conjunction with the accompanying Drawings in which:

FIG. 1 is a vertical cross-sectional view of a borehole illustrating a pump positioned therein constructed under the teachings of the present invention;

FIG. 2 is a vertical cross-sectional view of the borehole with the pump positioned therein after introduction of a pressurized pumping fluid into one pumping string.

DETAILED DESCRIPTION

Figure 3:
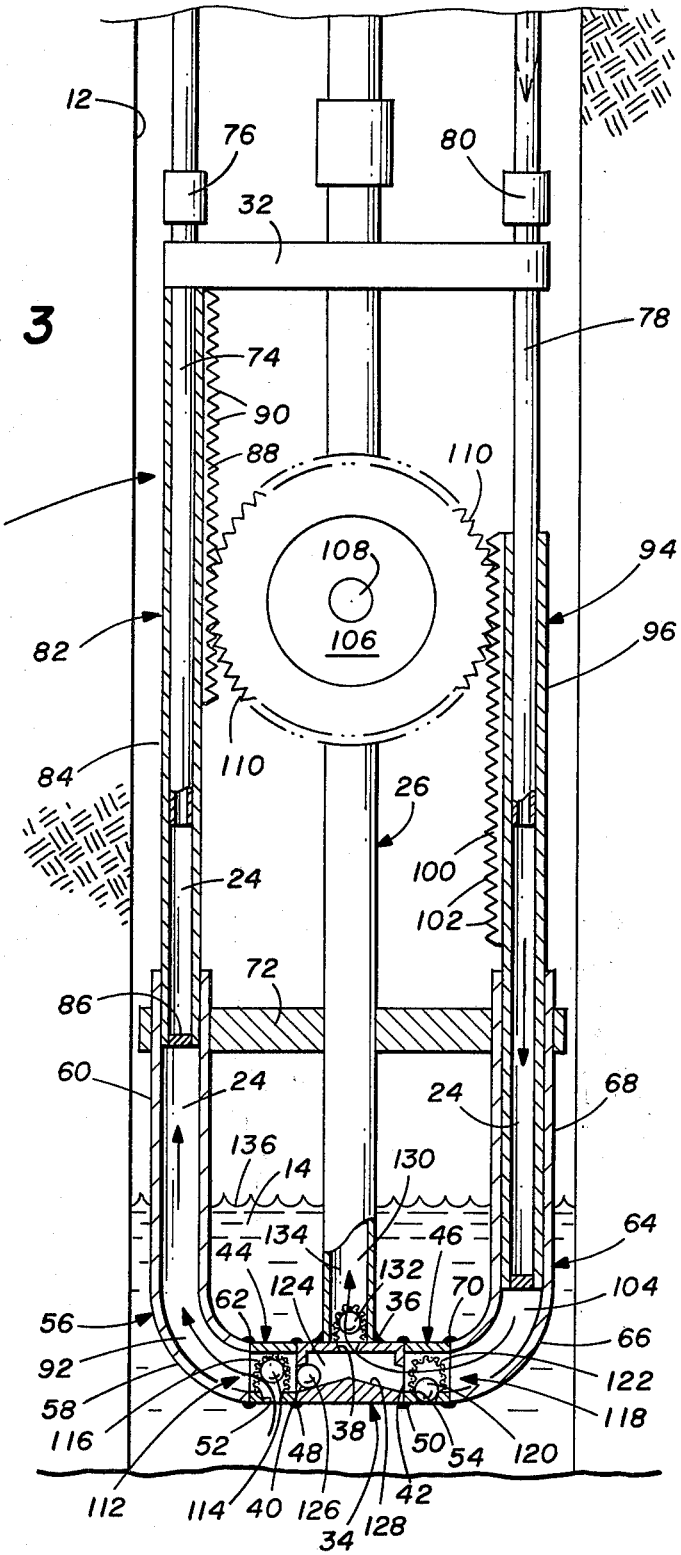
FIG. 3 is a vertical cross-sectional view of the borehole with the pump positioned therein after introduction of a pressurized pumping fluid into the other pumping string.

Referring now to the drawings, wherein like reference characters designate like or corresponding parts throughout several views, FIGS. 1–3 illustrate a pump 10 constructed from the teachings of the present invention and positioned in a borehole 12. The pump 10 is operable to lift a fluid 14, such as oil, from within the borehole to the surface 16 for storage within a storage tank 18.

The pump 10 includes a first pumping string 20 and a second pumping string 22 which each extend into the borehole 12 from the surface. The pumping strings 20 and 22 are adapted for holding a pumping fluid 24 therein. The pumping fluid 24 may be identical to the fluid 14 or may comprise another suitable fluid for performing the function described hereinafter, including water. A return string 26 extends out of the borehole to the surface to form a conduit for fluid 14 pumped to the surface in the manner described hereinafter. A connector 28 is positioned at the upper end of return string 26. A storage line 30 is connected at the other end of connector 28 and enters the storage tank 18. The pumping strings 20 and 22 and return string 26 are preferably held and fixed in a parallel relationship by cross members 32 interconnecting the strings.

A holding chamber section 34 is secured at the bottom end of the return string 26 as shown in FIGS. 2 and 3. The section 34 may be secured to the return string by welds 36. The holding chamber section 34 includes three orifices, 38, 40 and 42. A first fluid inlet section 44 is secured to section 34 and covers the orifice 40. A second fluid inlet section 46 is secured to the section 34 and covers the orifice 42. The inlet sections may be secured to the chamber section 34 as by welds 48 and 50. The first fluid inlet section 44 includes an orifice 52 and the end opposite orifice 40 is open. The second fluid inlet section 46 includes an orifice 54 and also has its end opposite orifice 42 open.

A first pumping cylinder 56 is secured to the first fluid inlet section 44 over the open end thereof. The pumping cylinder 56 includes a lower curved portion 58 extending from the inlet section and a substantially straight section 60 extending vertically and aligned with the first pumping string 20. The first pumping cylinder 56 may be secured to the first fluid inlet section as by welds 62.

A second pumping cylinder 64 is secured to the second fluid inlet section 46 about the open end thereof. The second pumping cylinder 64 also includes a curved portion 66 and a straight portion 68 aligned with the second pumping string 22. The second pumping cylinder may be secured to the second fluid inlet section as by welds 70. The first and second pumping cylinders are held in a fixed relation relative to the pumping strings and return string by a cross member 72.

The first pumping string 20 includes a polish rod 74 secured to the remainder of the string via a coupling 76. The second pumping string 22 includes a similar polish rod 78 mounted at the end within the borehole and secured to the remainder of the string via a coupling 80. A first pumping piston 82 is positioned for sliding motion relative to both polish rod 74 and the first pumping cylinder 76. The pumping piston 82 has an elongate cylindrical portion 84. End portion 86 closes off one end of the cylindrical portion and a gear rack 88 is mounted on the outside of the cylindrical portion 84 and extends therealong including teeth 90. The pumping piston 82 is movable between a retracted position, such as illustrated in FIG. 3 and an extended position, such as illustrated in FIG. 2. Suitable sealing materials are provided between the polish rod 74 and pumping piston 82 so that the pumping fluid 24 within the first pumping string 20 cannot flow between the polish rod and pumping piston. Similar suitable sealing materials are provided between the pumping piston 82 and the first pumping cylinder to define a first pumping chamber 92. It is clear by reference to FIGS. 2 and 3 that the volume of the pumping chamber 92 varies as the piston 82 is moved between the extended and retracted positions.

A second pumping piston 94 is positioned for slidable motion with respect to both polish rod 78 and the second pumping cylinder 64. The second pumping piston 94 includes a cylindrical portion 96 and end 98. A gear rack 100 is mounted on the outside surface of cylindrical portion 96 and includes teeth 102. The second pumping piston 94 is substantially similar in structure to the first pumping piston 82, and, may in fact be identical. Suitable sealing materials are provided between the polish rod 78 and second pumping piston 94 to confine the pumping fluid 24 in the second pumping string 22. Suitable sealing materials are provided between the second pumping piston 94 and the second pumping cylinder 64 to define a second pumping chamber 104. The pumping chamber 104 varies in volume as the second pumping piston 94 moves between the retracted position, illustrated in FIG. 2, and the extended position, illustrated in FIG. 3. The lower cross member 32 may serve as a stroke stop for both pumping pistons in the retracted position. However, if desired, a separate stroke stop may be provided.

A stroke return gear 106 is rotatably mounted along the lower portion of the return string by a rotary bearing 108. The gear 106 is positioned so that the teeth 110 thereof are meshed with the teeth 90 and 102 on the gear racks 88 and 100. When one of the pumping pistons is in motion, the gear 106 causes the other pumping piston to move in the opposite direction. In the preferred construction, the pumping pistons are positioned so that as one piston moves into the extended position, the other piston moves into the retracted position.

A first inlet valve 112 is provided in the first fluid inlet section 44. Valve 112 includes the orifice 52, a ball 114 for sealing engagement with the orifice and a cage 116 to maintain the ball in close proximity to the orifice. A second inlet valve 118 is positioned in the second fluid inlet section. Valve 118 includes the orifice 54, ball 120 for sealing engagement with the orifice and a cage 122 to maintain the ball in close proximity to the orifice.

A holding chamber 124 is defined within the holding chamber section 34 and includes a ball 126 therein for alternate sealing engagement with orifices 40 and 42.

The ball may roll between the two orifices on an inclined ramp 128. A standing valve 130 is provided between the holding chamber 124 and the return string. The standing valve includes an orifice 38 and a ball 132 for sealing engagement therewith. A cage 134 is provided to limit the motion of the ball 132 away from the orifice.

In operation, the pump 10 is lowered into the borehole 12 so that the orifices 40 and 42 extend beneath the free surface 136 of the fluid 14. By entering pumping fluid 24 into the first pumping string 20 at a predetermined pressure when the first pumping piston 82 is in the retracted position as shown in FIG. 3, the fluid urges the first pumping piston downward toward the extended position. This motion reduces the volume of the first pumping chamber 92 and increases the pressure of any fluid 14 therein to close the first inlet valve 112 to prevent the fluid from escaping back to the borehole. As the fluid 14 in pumping chamber 92 is pressurized, the ball 126 is forced into sealing engagement with orifice 42, preventing communication with the second pumping chamber 104. When the pressure in fluid 14 in the first pumping chamber 92 exceeds the pressure acting on standing valve 130 from the fluid in the drill string, the standing valve 130 is open to prevent fluid from the first pumping chamber to enter the drill string as shown in FIG. 2.

When the pumping fluid of predetermined pressure is entered into the first drill string 20, any pressure in the pumping fluid 24 in the second pumping string 22 is relieved. The downward motion of the first pumping piston 82 into the extended position roatates the gear 106 to move the second pumping piston 94 upward to the retracted position. As the piston is moved upwardly, the pressure within the second pumping chamber 104 decreases, opening the second inlet valve 118 to permit fluid 14 from the borehole to enter the pumping chamber104 as shown in FIG. 2. The fluid continues to flow into the second pumping chamber until the second pumping piston reaches the retracted position. Fluid is prevented from flowing back through inlet valve 118 as the ball 120 is moved into sealing engagement with the orifice 42.

The pressure is then relieved from the pumping fluid 24 in the first pumping string and the pumping fluid in the second pumping string is pressurized to the predetermined pressure. This causes the second pumping piston 94 to move downwardly to the extended position as shown in FIG. 3. As the second pumping piston 94 moves downwardly, the volume of the second pumping chamber 104 is reduced, pressurizing the fluid 14 therein. The pressurized fluid in the second pumping chamber retains the inlet valve 118 in the closed position and moves the ball 126 across the holding chamber into sealing engagement with the orifice 40. When the fluid in the second pumping chamber 104 achieves sufficient pressure to overcome the pressure of the head of fluid within the drill string, the standing valve 130 is open to permit the fluid to flow from the pumping chamber into the drill string as shown in FIG. 3. As the second pumping piston 94 is moved downwardly to the extended position, the first pumping piston 82 is moved upwardly to the retracted position, inducing flow from the borehole into the first pumping chamber 92. It is apparent from the discussion above that alternate application and release of pumping fluid at a predetermined pressure within the two pump strings induces pumping action within pump 10 to lift fluid 14 from within the borehole to the surface. While the pump 10 is preferably employed in the recovery of oil from within a borehole, the pump 10 may readily be adapted for lifting any fluid from a first elevation to a second higher elevation.

The preferred technique for alternately pressurizing the pumping fluid in the two pumping strings is illustrated in FIG. 1 and described herein. A cable drum 150 is mounted for rotation above the borehole 12 by a reversible electric motor 152. A swab line 154 passes over the grooves in the cable drum 150. Portion 156 of the swab line extends through a sealed orifice in the top of the first pumping string and into the interior thereof. A second portion 158 extends on the opposite side of the drum through a sealed orifice and into the second pumping string 22. Each portion 156 and 158 includes a sinker bar 160 and 162 secured thereto within the respective pumping string. Swab cups 164 and 166 are mounted at the lower ends of each of the sinker bars for slidable sealed motion against the interior of the pumping strings. The swab cup separates the drill strings into upper and lower sections. However, pumping fluid 24 is provided throughout the upper and lower sections of both pumping strings. A connector 168 interconnects the upper sections of both pumping strings and permits pumping fluid to flow therebetween.

The lower sections of each pumping string may be alternately pressurized to the predetermined pressure by rotating the cable drum 150 in one direction for a number of revolutions and reversing the rotation for the identical number of revolutions. As the swab cups in one string move upward, they pressure the fluid above them and in the other string through connector 168. The pressure in the fluid below is simultaneously relieved. While this is one technique for alternately pressurizing and relieving the pressure of pumping fluid in the pumping strings, it is clear that any other suitable technique may be employed with the pump 10.

The pump 10 clearly has many desirable features not heretofore provided by the prior art pumping devices. While the pumping strings described and illustrated extend in a linear manner from the surface, it is clear that the pumping string need only permit flow of pumping fluid therein from the surface to the pumping pistons and may therefore take a variety of shapes necessitated by the environment of borehole 12 or other application. The relative simplicity of the pump 10 promotes reliability and cost effectiveness. The length of stroke of pump 10 may be varied by merely changing the length of the pumping pistons, providing great flexibility in applying the pump 10 in use.

While only one embodiment of the present invention has been described in detail herein and shown in the accompanying Drawings, it will be evident that various further modifications and substitutions are possible without departing from the scope of the invention.

I claim:

1. A pump for pumping a fluid from a first elevation to a higher, second elevation, said pump comprising:

first and second pumping strings for extension adjacent the first elevation for carrying a pumping fluid;

a return string for extension between the first and second elevations for carrying the fluid to the second elevation;

first and second hydraulic pistons slideably mounted on said first and second pumping strings, respectively, for reciprocating motion between extended and retracted positions;

a hydraulic pumping fluid disposed in said first and second pumping strings in hydraulic contact with said first and second hydraulic piston to apply hydrostatic pressure thereto;

a first pumping cylinder secured in a fixed relation to said first pumping string, said first piston extending into said first cylinder to define a first pumping chamber, the volume of the first pumping chamber varying as said first piston reciprocates, the first pumping chamber being interconnected with said return string;

first inlet valve means for permitting fluid at the first elevation to enter the first pumping chamber;

a second pumping cylinder secured in a fixed relation to said second pumping string, said second piston extending into said second cylinder to define a second pumping chamber, the volume of said second pumping chamber varying as said second piston reciprocates, the second pumping chamber being interconnected with said return string;

second inlet valve means for permitting fluid at the first elevation to enter the second pumping chamber;

standing valve means positioned in said return string permitting fluid flow therethrough only toward the second elevation;

valve means to prevent flow of fluid between said first and second pumping chambers;

gear means interconnecting said first and second pistons so that motion in one of said pistons toward the extended position directly induces a corresponding opposite motion in the other said piston to the retracted position;

means for reciprocating said first and second pistons by decreasing the hydrostatic pressure applied to one of said first and second pistons and simultaneously increasing the hydrostatic pressure to the other of said first and second pistons, said reciprocating means alternating the increase and decrease of hydrostatic pressure between said first and second pistons; and said gear means directly translating reciprocal motion of one of said first and second pistons to the other one thereof in the opposite reciprocating direction, retraction of one of said first and second pistons causing the respective one of said first and second inlet valve means, respectively, to open, permitting fluid to flow into the respective one of said first and second pumping chambers at the first elevation, extension of the other of said first and second pistons causing the fluid contained in the respective one of said first and second pumpingchambers to flow through said standing valve means.

2. The pump of claim 1 wherein said reciprocating means comprises;

first swab cup means slideable within said first pumping string and in sealing engagement therewith to prevent pumping fluid flow thereby to define upper and lower sections in said first pumping string;

second swab cup means slideable within said second pumping string and in sealing engagement therewith to prevent pumping fluid flow thereby to define upper and lower sections in said second pumping string;

a connector interconnecting the upper sections of said first and second pumping strings for allowing fluid flow therebetween; and means for alternately sliding said first and second swab cup means to increase the volume of the lower sections of said first and second pumping strings, the sliding motion of one of said swab cup means to increase the volume of the lower section relieving the hydrostatic pressure of said pumping fluid therein while simultaneously increasing the hydrostatic pressure of said pumping fluid in the upper section and the other pumping string

3. The pump of claim 1 wherein said gear means comprises a gear rotatably mounted about an axis having a fixed relation to said pumping strings and said pumping cylinders, each of said pumping pistons including a gear rack having gear teeth thereon meshing with the teeth on said gear.

4. A pump for pumping a fluid from a borehole, comprising:

first and second pumping strings for extension into the borehole, each of said pumping strings ending in a polish rod within the borehole;

first and second pistons slideably supported on the polish rods of said first and second pumping strings, respectively, for reciprocation thereon between retracted and extended positions, each of said pistons having a gear rack secured thereto;

a pumping fluid disposed in said first and second pumping strings in hydraulic contact with said first and second pistons;

a connector disposed between said first and second strings for allowing said pumping fluid to flow therebetween;

a return string for extension out of the borehole for carrying the fluid out of the borehole, the polish rods of said first and second pumping strings being positioned in a fixed relation to said return string;

a standing valve communicating with said return string for permitting flow therethrough in the direction forcing fluid from the borehole;

a first pumping cylinder secured in a fixed relation to the polish rod of the first pumping string, said first piston extending into said first cylinder to define a first pumping chamber, the volume of the first pumping chamber decreasing as said first piston moves toward the extended position, the first pumping chamber being in fluid communication with said standing valve through a first orifice;

a first inlet valve for permitting fluid flow only into the first pumping chamber from the borehole;

a second pumping cylinder secured in a fixed relation to the polish rod of said second pumping string, said second piston extending into said second cylinder to define a second pumping chamber, the volume of the second pumping chamber decreasing as said second piston moves toward the extended position, the second pumping chamber being in fluid communication with said standing valve through a second orifice;

a second inlet valve for permitting fluid to flow only into said second pumping chamber from the borehole;

a stroke return gear rotatably mounted about an axis fixed relative to said return string, said gear having teeth thereon meshing with the teeth on said first and second pistons, motion of one of said pistons toward the extended position forcing the other piston toward the retracted position;

means for alternately sealing the first and second orifices to prevent fluid flow between the first and second pumping chambers; and means for reciprocating said first and second pistons by displacing said pumping fluid from one of said first and second pumping strings to the other of said strings through said connector to decrease the hydrostatic pressure applied to one of said first and second pistons causing retraction thereof and increasing hydrostatic pressure to the other piston thereof causing extension thereof, said reciprocating means altering the displacement of said pumping fluid between said first and second strings;

said gear means directly translating reciprocal motion of one of said first and second pistons to the other one thereof in the opposite reciprocating direction, retraction of one of said first and second pistons causing the respective one of said first and second inlet valve means, respectively, to open, permitting fluid to flow into the respective one of said first and second pumping chambers at the first elevation, extension of the other said first and second pistons causing the respective one of said first and second pumping chambers to flow through said standing valve means.

5. The pump of claim 4 wherein said means for reciprocating comprises:

first swab cup means slideable within said first pumping string and in sealing engagement therewith preventing pumping fluid from flowing thereby to define upper and lower sections in said first pumping string;

second swab cup means slideable within said second pumping string and in sealing engagement therewith preventing pumping fluid from flowing thereby to define upper and lower sections in swid second pumping string;

a first swab line portion secured to said first swab cup means and extending out of said first pumping string;

a second swab line portion to said second swab cup means and extending out of said second pumping string; and means for alternately tensioning said first and second swab line portions to alternately move said first and second swab cup means to displace said pumping fluid in the upper section of the respective one of said first and second pumping strings to the other said pumping strings.

6. The pump of claim 4 wherein the pumping fluid comprises the fluid to be pumped from the borehole.

7. A pump for pumping a fluid from the borehole, comprising:

first and second pumping strings for extension into the borehole, each of said pumping strings ending in a polish rod within the borehole, each of said polish rods being aligned parallel;

pumping means for alternately introducing a pumping fluid into said first and second pumping strings at a predetermined pressure said pumping means simultaneously creating a negative pressure in the pump string not pressurized;

first and second pistons slidably supported on the polish rods of said first and second pumping strings, respectively, and hydraulically operated by said pumping means for reciprocation thereon between retracted and extended positions, each of said pistons having a gear rack secured thereto having gear teeth;

a return string for extension out of the borehole for carrying fluid to be pumped from the borehole, said return string being supported in a fixed relation to the polish rods of said first and second pumping strings;

a holding chamber section secured to said return string, said holding chamber section defining a holding chamber in fluid communication with said return string, said holding chamber section further having first and second orifices therethrough;

a first cylinder secured to said holding chamber section in a fixed relationship to the polish rod of said first pumping string, said first piston extending into said first cylinder to define a first pumping chamber, the volume of said first pumping chamber being varied as said first piston moves between the extended and retracted positions, said first pumping chamber being in fluid communication with the holding chamber through the first orifice;

a first inlet valve positioned in said first cylinder permitting fluid to flow from the borehole into the first pumping chamber when the pressure in the borehole is greater than the pressure in the first pumping chamber;

a second cylinder secured to said holding chamber section in a fixed relationship to the polish rod of said second pumping string, the second piston extending into said second cylinder to define a second pumping chamber, the volume of the second pumping chamber being varied as said second piston is moved between the extended and retracted positions, the second pumping chamber being in fluid communication with the holding chamber tthrough the second orifice;

a second inlet valve secured to said first cylinder permitting fluid to flow from the borehole into the second pumping chamber when the pressure in the borehole exceeds the pressure in the second pumping chamber;

a standing valve interconnecting the holding chamber and the return string, said standing valve permitting fluid to flow therethrough only from the holding chamber into the return string;

a stroke return gear rotatably mounted on said return string, the teeth of said gear being meshed with the teeth on said first and second pistons so that motion in one piston toward the extended position urges the other piston toward the retracted position;

valve means for sealing the first orifice to prevent fluid flow between the first pumping chamber and the holding chamber when the fluid pressure in the second pumping chamber exceeds the fluid pressure in the first pumping chamber, said valve means further blocking the second orifice to prevent fluid flow between the second pumping chamber and the holding chamber when the fluid pressure in the first pumping chamber exceeds the fluid pressure in the second pumping chamber; and the introduction of pumping fluid at the predetermined pressure into said first pumping string urging said first piston to the extended position and fluid in the first pumping chamber through the first orifice and said standing valve to drive fluid from the borehole, the motion of said first piston to the extended position forcing said second piston to the retracted position with the assist of the negative pressure created in said second pumping string by said pumping means said valve means sealing the second orifice, the motion of said second piston to the retracted position causingsaid second inlet valve to open permitting fluid to flow into the second pumping chamber from the borehole, the introduction of pumping fluid into said second string at the predetermined pressure and the creation of negative pressure in said first string urging said second piston to the extended position and pumping fluid in the second pumping chamber through the second orifice and said standing valve to drive fluid from the borehole, said valve means sealing the first oificie and the motion of said first piston toward the retracted position opening said first inlet valve to permit fluid to flow into the first pumping chamber from the borehole.

8. The pump of claim 7 wherein said means for alternately introducing pumping fluid at a predetermined pressure in each pumping string comprises:

at least one first swab cup positioned for slidable sealed contact within said first pumping string dividing said first pumping string into upper and lower sections;

at least one second swab cup positioned for slidable sealed contact within said second pumping string and dividing said second pumping string into upper and lower sections;

a connector interconnecting the upper sections of said first and second pumping strings to permit pumping fluid to flow therebetween; and means for alternately moving each of said first and second swab cups to increase the volume of the lower section in its associated pumping string for pressurizing the pumping fluid in the upper sections of each of said pumping strings and the lower section of the other pumping string to the predetermined pressure while simultaneously creating a negative pressure in the lower portion of the associated pumping string.

9. The pump of claim 7 wherein said pumping fluid comprises the fluid to be pumped from the borehole.

* * * * *

UNITED STATES PATENT AND TRADEMARK OFFICE

CERTIFICATE OF CORRECTION

PATENT NO. : 4,427,348

DATED : January 24, 1984

INVENTOR(S) : William M. Kofahl

It is certified that error appears in the above-identified patent and that said Letters Patent is hereby corrected as shown below:

Abstract, line 6, "puming" should be --pumping--.

Col. 1, line 7, between "oil" and "within" insert --from--;
line 40, "retraced" should be --retracted--.

Col. 2, line 61, "simulatneously" should be --simultaneously--.

Col. 5, line 32, "roatates" should be --rotates--.

Col. 7, line 52 (Claim 1), "pumpingchambers" should be --pumping chambers--.

Col. 8, line 9 (Claim 2), after "string" insert --.--.

Col. 9, line 36 (Claim 5), "swid" should be --said--;
line 41 (Claim 5), between "portion" and "to" insert --secured--.

Col. 11, line 4 (Claim 7) "causingsaid" should be --causing said--;
line 14 (Claim 7), "oificie" should be --orifice--.

Signed and Sealed this

*Fifteenth* Day of *May 1984*

[SEAL]

*Attest:*

GERALD J. MOSSINGHOFF

*Attesting Officer*

*Commissioner of Patents and Trademarks*